US007601408B2

(12) United States Patent
Young et al.

(10) Patent No.: US 7,601,408 B2
(45) Date of Patent: Oct. 13, 2009

(54) MICROWAVE SUSCEPTOR WITH FLUID ABSORBENT STRUCTURE

(75) Inventors: Robert C. Young, 301 E. 78th St., New York, NY (US) 10021; Johan Kools, Oudenbosch (NL)

(73) Assignee: Robert C. Young, Greenpoint, NY (US)

( * ) Notice: Subject to any disclaimer, the term of this patent is extended or adjusted under 35 U.S.C. 154(b) by 867 days.

(21) Appl. No.: 10/209,907

(22) Filed: Aug. 2, 2002

(65) Prior Publication Data

US 2004/0023000 A1 Feb. 5, 2004

(51) Int. Cl.

| | |
|---|---|
| ***B32B 27/32*** | (2006.01) |
| ***B32B 27/06*** | (2006.01) |
| ***B32B 27/00*** | (2006.01) |
| *B32B 29/00* | (2006.01) |

(52) U.S. Cl. ..... 428/35.2; 428/34.1; 428/34.2; 428/35.7; 428/35.9; 428/36.1; 428/458; 428/461; 428/463; 428/411.1; 428/457

(58) Field of Classification Search ..... 428/34.1, 428/34.2, 35.7, 35.9, 36.1, 458, 461, 463, 428/411.1, 457

See application file for complete search history.

(56) References Cited

U.S. PATENT DOCUMENTS

| | | | | |
|---|---|---|---|---|
| 4,015,085 A | | 3/1977 | Woods | 219/729 |
| 4,590,349 A | | 5/1986 | Brown et al. | 219/730 |
| 4,641,005 A | | 2/1987 | Seiferth | 219/10.55 E |
| 4,894,247 A | | 1/1990 | Fong | 426/107 |
| 4,927,991 A | | 5/1990 | Wendt et al. | 219/10.55 E |
| 4,933,193 A | | 6/1990 | Fisher | 426/107 |
| 4,950,524 A | | 8/1990 | Hacker | 428/167 |
| 5,021,293 A | * | 6/1991 | Huang et al. | 428/328 |
| 5,096,772 A | * | 3/1992 | Snyder | 428/105 |
| 5,124,519 A | | 6/1992 | Roy et al. | 219/10.55 E |
| 5,164,562 A | | 11/1992 | Huffman et al. | 219/10.55 E |
| 5,180,894 A | * | 1/1993 | Quick et al. | 219/730 |
| 5,194,408 A | * | 3/1993 | Stamp et al. | 501/88 |
| 5,349,168 A | * | 9/1994 | Wilen | 219/730 |
| 5,399,842 A | * | 3/1995 | Watanabe et al. | 219/730 |
| 5,414,248 A | | 5/1995 | Phillips | 219/730 |
| 5,585,027 A | * | 12/1996 | Young | 219/730 |
| 5,614,259 A | | 3/1997 | Yang et al. | 427/255.1 |

FOREIGN PATENT DOCUMENTS

| | | |
|---|---|---|
| EP | 0 350 249 | 1/1990 |
| WO | WO 01/30657 A2 | 5/2001 |

OTHER PUBLICATIONS

Science & Technology, "Why the Heat-and-Eat Market is Really Cooking", Business Week, Jun. 27, 1988, pp. 90-91.

* cited by examiner

*Primary Examiner*—Marc A Patterson
(74) *Attorney, Agent, or Firm*—Oliff & Berridge, PLC

(57) ABSTRACT

A susceptor includes an absorbent substrate layer; a first susceptor layer including microwave susceptor material over the substrate layer; and a first protective overcoating layer over the first susceptor layer, where the absorbent substrate layer comprises non-woven fibers.

24 Claims, 12 Drawing Sheets

MICROWAVE SUSCEPTOR WITH FLUID ABSORBENT STRUCTURE

BACKGROUND OF THE INVENTION

1. Field of Invention

This invention relates to microwave active susceptors, and particularly such susceptors suitable for use in the packaging and preparation of microwave food products, where the susceptor structure includes a fluid absorbent structure, which absorbs such fluids as water, moisture, oil, fat, grease, and the like.

2. Description of Related Art

The use of microwave energy revolutionized food preparation and has now become common place, both in businesses and in the home. However, the advantages associated with microwave usage are tempered with compromises to food appearance, texture, flavor, and sometimes ease of preparation. In particular, although microwave energy can be used to cook foods, it lacks the ability to provide a crisping effect to the bakery or breaded/fried foods. Accordingly, a majority of uses of the microwave ovens is to reheat precooked (such as frozen) food products, rather than to cook uncooked food products in the first instance.

In the past, difficulties have been experienced in various attempts to brown or crispen food products in a microwave oven. A microwave oven heats foods differently from a conventional oven, which cooks the food entirely by radiant heat. Generally speaking, food substances are heated in proportion to their moisture content and absorption of microwave energy, which may result in considerably different heating patterns from those that exist in a conventional oven. Also, this dielectric heating by microwave radiation penetrates into most foods in a way that results in considerably different heating patterns from those that would otherwise be present in a conventional oven. In most cases, microwave energy will heat foods faster than in a conventional oven. For example, a food substance that might require 30 minutes to properly "cook" or reheat in a conventional oven, may take only 3 or 4 minutes to "cook" or reheat in a microwave oven. In a conventional oven, the oven atmosphere is heated to relatively high temperatures to transfer heat to the food surface resulting in the surface always being the hottest area in the food. In a microwave oven, the oven atmosphere is generally not heated; the food itself heats and transfers heat to the surrounding air and in some cases resulting in the outer surface of the food being cooler than the interior or having a soggy surface as the heated interior moisture and steam travel through the outer pastry layers. These differences significantly affect one's ability to brown or crispen a surface of a food product in a microwave oven as the food surface is not exposed to conventional or radiant heat.

To compensate for the microwave oven's inability to crisp and brown the surface of foods, and to prevent foods that are highly absorptive of microwave energy from being overheated, resulting in toughening and dehydration of the food, two specific "microwave active" packaging components have been developed: microwave susceptors and microwave shields.

Microwave shields are devices that do not heat appreciably in response to microwave energy, but reflect virtually all incident microwaves. Metallic foils are generally employed as microwave shields, which has the effect of shielding the food from microwave energy.

In contrast, microwave susceptors are devices that heat in response to microwave energy, converting microwave energy into thermal energy to produce radiant heat that can provide a browning and/or crisping effect to food surfaces placed in contact with the microwave susceptors. Microwave susceptors thus convert a portion of the incident microwave energy into conventional or radiant heat, which assists in cooking the food product's outer surface. Such cooking occurs by any of conduction, convection and/or radiant heating, in addition to the cooking obtained from the microwave radiation itself that has passed through the susceptor laminate. Susceptors may generally comprise almost any portion of the cooking and/or packaging surfaces, and have suitably been employed in the forms of the cooking surfaces of kitchen utensils, the bottom of packaged food products, such as unpopped popcorn, incorporated into folding cartons or trays, and a food wrap for a food product, such as meat-filled sandwiches, bread, and pastry-type products, which when cooked desirably should have a browned or crisped exterior surface.

Because of the above-described problems with browning and crisping foods in microwave ovens, the goal in the art of susceptors had been, and still is, to make the susceptor so that it generates the highest temperatures and most radiant heat possible. This goal was used because generation of the highest temperature possible also tends to mean that the cooking or heating time can be shortened, which is a primary advantage of microwave ovens. Furthermore, when a food load is close to the susceptor surface, heat can be transferred to the food as fast as it is produced by the susceptor.

Susceptors frequently comprise or are included in the packaging for food products as a convenience to the consumer, so that the consumer can simply place the product into a microwave oven without any significant preparation. As a further convenience, such packaging is customarily disposable. Thus, there is a particular need for susceptors that are economical.

However, since susceptors will be brought into contact with foods intended for human consumption, it is necessary to encapsulate the microwave interactive material within films or the like that are approved for contact with food, thus resulting in a multi-layer susceptor product. Such multi-layer products are generally known in the art, and have taken many forms. Customarily, the susceptor product comprises a base sheet such as paper, cellophane, cardboard, box board or the like, a thin layer of microwave interactive material, such as aluminum and/or other selected metals, combinations of metals, alloys and oxides, and a heat resistant barrier film overlying the thin metal layer.

The multi-layer sheet may then be die cut, folded into cartons or pressed into preformed trays or containers and/or decorated with printing to form a package into which food may be inserted by a food processor. Alternatively, the multi-layer sheet may comprise a flexible laminate, which can be formed around a food product as a wrapping material at the food processor's plant. Alternatively, susceptor laminations may be configured as a variety of flexible paper or paper board structures, such as wraps, bags, pouches, sleeves, trays, pads, discs, sleeves, patches, liners, lids, and other designs that would enable the home user and food processor to utilize susceptor materials for their own microwave suitable foods.

The barrier film is typically a polyester (PET) film, due primarily to its heat resistant properties and low cost. However, the barrier film may also be polyimide, cellulose, polyethylene nitrile and other heat resistant films. Its purpose is to provide a functional barrier between the food product and as a carrier for the susceptor metal, and sometimes also to serve as a carrier for a sealable layer to facilitate formation of a package.

The microwave interactive susceptor material is typically a metal, combinations of metals, metal alloy, metal oxide, or derivatives and/or combinations thereof, in single or multi-layer formations, but also may be ceramic or carbon. Any element or compound that absorbs the electromagnetic microwave energy, either electrical and/or magnetic wave forms, and converts it to radiant heat is suitable. The metals are usually applied by using evaporative, sputtering, or electron-beam deposition methods. The metals may also be applied using such suitable methods as printing or gravure processes, and combinations of pre-selected designs of shielding and susceptor patterns and designs can be manufactured by controlled acid etching. Flakes and slurries of susceptor materials, which may be controlled acid etched to provide variations in susceptor radiant heat, are sometimes applied in a rotary printing process. Ceramics and carbon may also be applied in a rotary printing process.

Typically, the susceptor is formed by depositing a film or layer of the microwave interactive material onto the barrier film, e.g., a web of polyester film, followed by laminating the metallized film onto a web of supporting substrate material, usually board, paper or cellulose.

Numerous variations of susceptor materials and manufacturing methods have been proposed and disclosed in the art.

For example, U.S. Pat. No. 4,641,005 to Seiferth discloses a disposable food receptacle for use in microwave cooking, which includes a thin layer of an electrically conductive material, such as an elemental metal such as aluminum, to brown the exterior of the food product. The electrically conductive material is formed as an extremely thin film deposited on a substrate protective layer by a process of a vacuum vapor deposition.

U.S. Pat. No. 5,614,259 to Yang et al. teaches a microwave interactive susceptor in end product condition or form, which are produced by a continuous in-line production method. In the production method, under continuous vacuum, a paper or board substrate is first coated with a thin film of monomer that is cured to a polymer, a metal or other microwave interactive susceptor material is vapor or sputter deposited onto the polymer film, either in an overall layer or preselected pattern, and a thin film monomer is deposited over the susceptor layer and cured or polymerized. The result is described to be an end product ready for use. The process is described to avoid the previously required polyester substrate, and can be made without requiring lamination of a metallized film to a paper or board backing.

U.S. Pat. No. 5,164,562 discloses a combined microwave susceptor/microwave shield packaging product. The packaging comprises at least two spaced susceptor layers in overlying relation. The packaging is described as providing a food packaging/cooking product that keeps the inside of the food product moist without drying out, while heating the surface of the product to a high enough temperature to brown the surface.

U.S. Pat. No. 4,927,991 to Wendt et al. similarly teaches a food package for microwave oven use including a susceptor material in combination with a grid. The combination of the grid and susceptor are described as providing a heating element, which substantially maintains its reflectance, absorbance and transmittance during microwave cooking. The patent describes that this grid and susceptor combination provides substantial uniformity of heating.

However, despite the numerous approaches that have been made to susceptor materials, a common problem with the susceptors is that during use, i.e., during cooking, excess moisture, grease and oil from the food product collect at the surface of the susceptor (polyester film), and thus at the outer surface of the food product. Accordingly, the food product sits in a puddle of food liquids. The result is a soggy food product that has decreased appeal to the end user. The presence of the excess moisture, grease and oil can also deteriorate the food quality, since it results in the food product having a different texture, taste, and appearance from what is expected. The art has recognized this problem that the susceptor materials do not adequately absorb excess grease and oil from food products during cooking.

To overcome this difficulty, the art has proposed the use of nonwoven materials as grease absorbing elements in microwave food packaging. For example, the references "Why the Heat-and-Eat Market is Really Cooking," *Business Week,* Jun. 27, 1988, and "Microwave Packet Broils Bacon Cleanly," *Packaging Technology,* July 1988, report the introduction of packaging by Wright Brand Foods Inc. and Geo. A. Hormel & Co. developed by 3M Corp. for browning bacon. The package includes an expandable plastic bag and absorbent MICROINSORB® 3M nonwoven pad. Steam generated during cooking of the bacon is contained in the bag to limit evaporative cooling. A high temperature and crisping is effected by the microwave excitation of bacon grease in the package. It is asserted that the nonwoven MICROINSORB® pad also absorbs grease to provide a quality product.

The *Business Week* reference reports, however, that the product has limited application in browning food products, because steam is not an appropriate medium for browning food products and most foods do not have the high grease content of bacon. Moreover, it is desirable to provide a packaging material that has application for cooking of packaged and non-prepackaged foods.

U.S. Pat. No. 5,124,519 discloses a microwave susceptor composite that includes a first layer of polymeric fibrous material, and a second layer of thermoplastic polymer material having microwave susceptive characteristics. The polymeric susceptor and polymeric fibrous material layers are arranged in lamina surface-to-surface contact and bonded into an integral structure by application of heat and pressure. A uniform composite material is obtained by carding the polymeric fibrous materials prior to bonding the first and second layers. In microwave cooking applications, the fibrous layer of the composite absorbs excess effluents from the food product. Browning and crisping of food products is effected by microwave excitation of the metallized second layer of the composite.

U.S. Pat. No. 5,414,248 discloses an insert useful in a microwavable food container comprising a metallized layer of heat susceptor thickness or a plastic layer, having openings that are in a position to be adjacent to food in the container, a layer of absorbent material comprising fibers, and a substrate layer that is stable to microwave heating conditions. The inserts can also comprise fibers that are capable of spontaneously transporting water or n-decane on the surface thereof.

SUMMARY OF THE INVENTION

However, despite the many approaches that have been taken in manufacturing microwave susceptor materials, the need continues to exist for improved susceptor materials. In particular, the need continues to exist for improved susceptor materials that provide a browning and crisping effect to the food product, particularly in reheating frozen fried, pastry and bakery type foods including meat, vegetables, and fruit-filled pastry and bakery type products, and in particular high water/oil content fish, meat and vegetable products and breaded and/or battered fillets and frozen products, where the presence of excess moisture, grease and oil may be a concern.

The present invention satisfies these needs, by providing a susceptor material that provides improved cooking properties to a food product by absorbing excess liquid, such as moisture, grease and oil, that is liberated from the food product. The material thus provides a dual purpose of providing an absorptive substrate while also acting as a susceptor, permitting microwave cooking of the food product and providing desirable browning and crisping of the outer surface of the food product.

In particular, the present invention provides:

a susceptor comprising:
- an absorbent substrate layer;
- a first metallized layer over said substrate layer; and
- a first protective overcoating layer over said first metallized layer, which protective layer may optionally be perforated,
- wherein said absorbent substrate layer comprises non-woven fibers.

BRIEF DESCRIPTION OF THE DRAWINGS

These and other advantages and features of this invention will be apparent from the following, especially when considered with the accompanying drawings, in which.

DETAILED DESCRIPTION OF PREFERRED EMBODIMENTS

Figure 1:
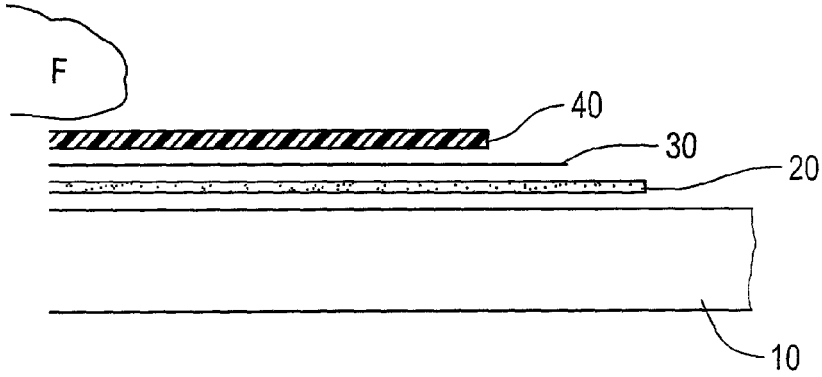
Fig. 1 (PRIOR ART)
FIG. 1 shows the layers of a conventional susceptor material.

A typical conventional susceptor material is shown in FIG. 1. As shown in FIG. 1, the susceptor generally comprises a base or substrate layer 10 such as made from kraft paper or SBS paper board, an adhesive layer 20, a metallized susceptor layer 30, and a protective coating layer 40 of polyester or other heat stable material. The food load F is placed next to or contacting with the protective coating layer 40.

According to the present invention, however, the susceptor structure is modified to provide an absorbent structure. The absorbent structure is suitable, for example, for absorbing excess moisture, grease and/or oil that is liberated from the food product during microwave cooking/heating of the food.

Figure 2:
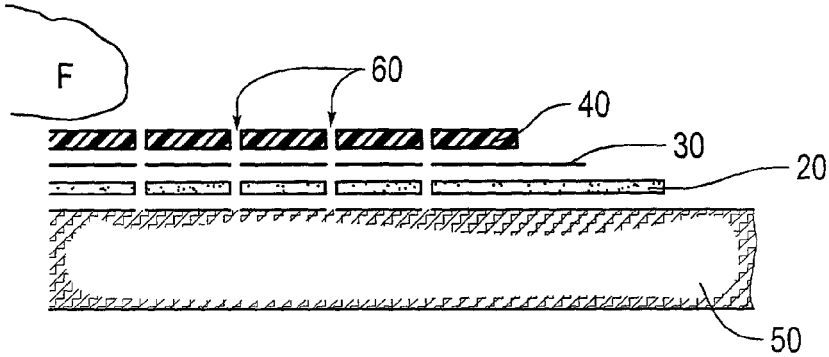
FIG. 2 shows the layers of a susceptor material according to an embodiment of the present invention.

An embodiment of the present invention is shown in FIG. 2. As shown in FIG. 2, the susceptor material generally follows the same structure as in FIG. 1, except that the base 10 is substituted by a base 50, which is made of a paper, board, paper/board, or other non-woven material that has moisture and grease/oil absorbing properties. In addition, the material differs from the conventional susceptor of FIG. 1 by including perforations, voids or cut-outs 60 in the upper layers of the structure. As desired, the perforations, voids or cut-outs 60 may or may not be totally carried through the entire structure substrate, i.e., the perforations, voids or cut-outs 60 may be made through one or more selective layers of the susceptor, or may be made through all of the layers of the susceptor. In use, a food product (food load F) would be placed next to or in contact with the protective coating layer 40. Of course, the specific layers of susceptors according to the present invention are not limited to this specific embodiment. Thus, for example, a similar structure (not shown) can be formed by omitting the adhesive layer 20, and instead assembling the respective layers using alternative methods such as cold, hot and extrusion lamination or onto a cured polymer, as in a vacuum metallization process.

Figure 3:
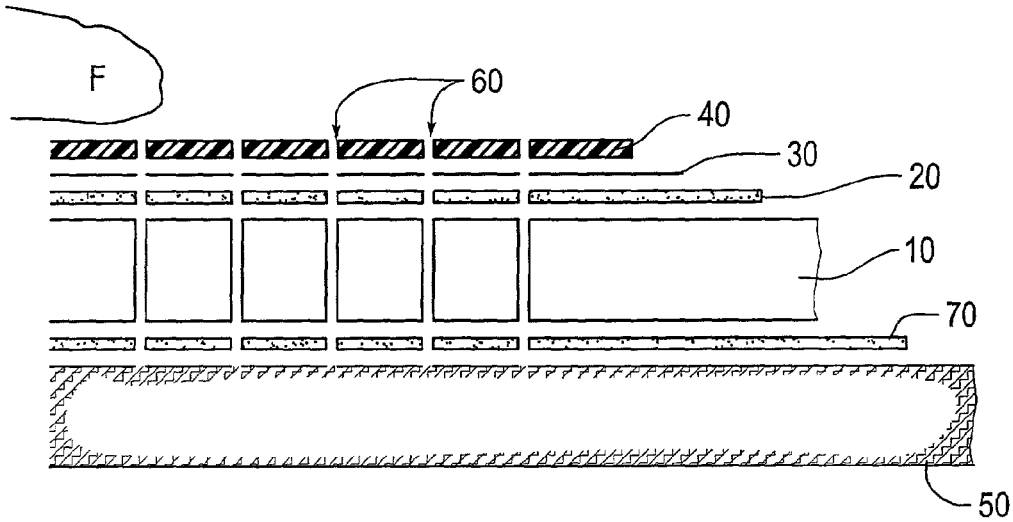
FIG. 3 shows the layers of a susceptor material according to another embodiment of the present invention.

An alternative embodiment of the present invention is shown in FIG. 3. As shown in FIG. 3, the susceptor material follows the same structure as in FIG. 1, except that the base 10 is further laminated to an absorbent base material 50 by an optional adhesive layer 70. In addition, the material differs from the conventional susceptor of FIG. 1 by including perforations or cut-outs 60 in the upper layers of the structure. In use, a food product (food load F) would be placed next to or in contact with the protective coating layer 40. Of course, the specific layers of susceptors according to the present invention are not limited to this specific embodiment.

Figure 4A:
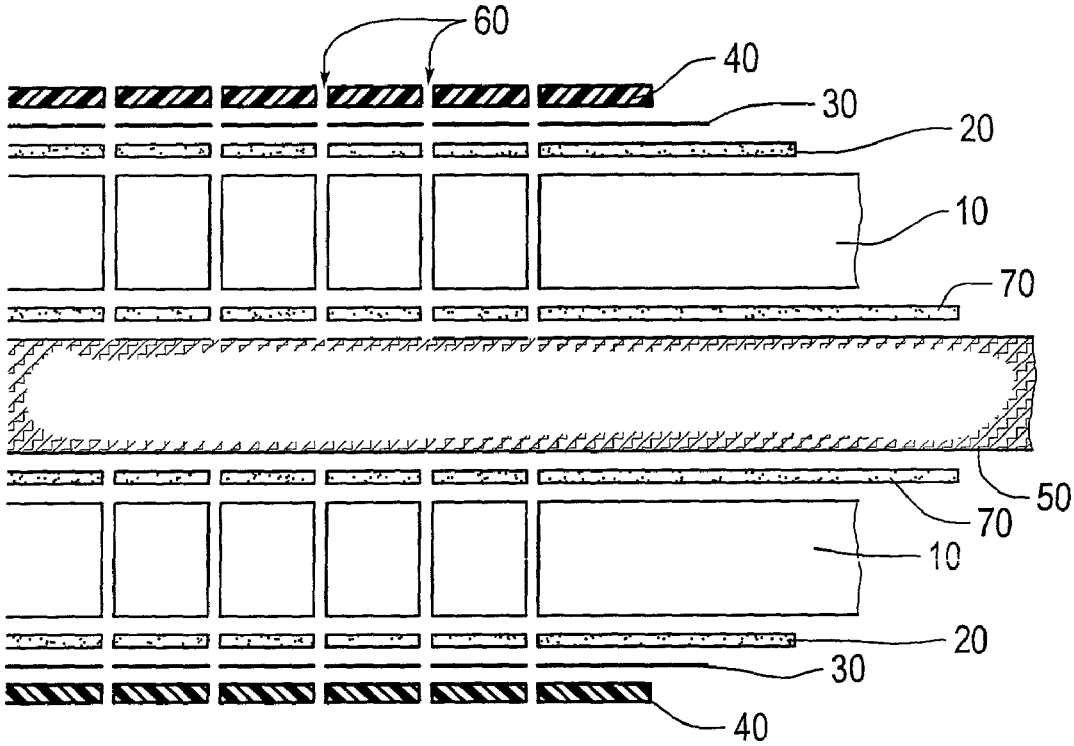
FIGS. 4*a*-4*b* show the layers of susceptor materials according to modified embodiments of the present invention.
Figure 4B:
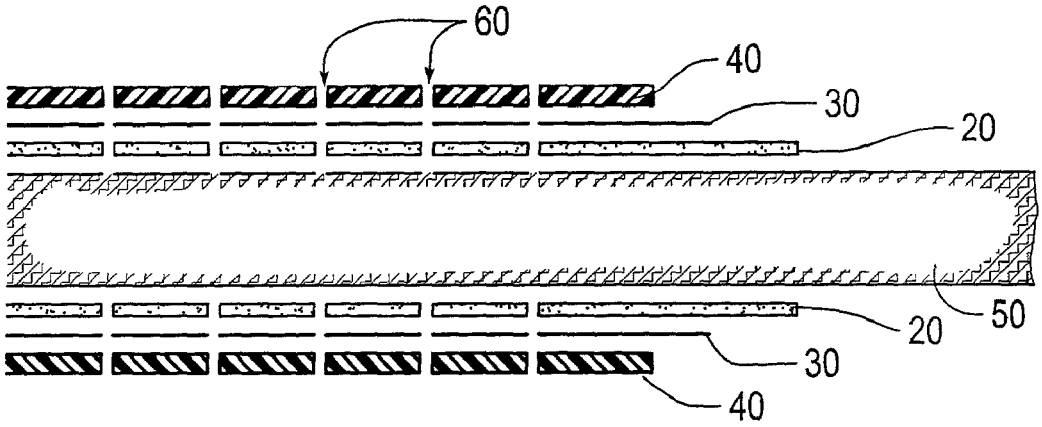

A still further embodiment of the present invention is shown in FIGS. 4*a* and 4*b*. The embodiments shown in FIGS. 4*a* and 4*b* follow the structures of FIGS. 3 and 2, respectively, except that a further susceptor layer is added to the underside of the base 50. Thus, for example, FIG. 4*a* shows the susceptor structure of FIG. 3, with the addition of a further optional adhesive layer 70 to bond a second susceptor structure 10,20, 30,40 to the underside of the absorbent base layer 50. Likewise, FIG. 4*b* shows the susceptor structure of FIG. 2, with the addition of a second susceptor structure 20,30,40 on the underside of the absorbent base layer 50. As with the above embodiments, the susceptor materials include perforations or cut-outs 60 in the upper and/or lower layers of the structure. In use, a food product (not shown) would be placed next to or in contact with either of the protective coating layers 40. Of course, the specific layers of susceptors according to the present invention are not limited to this specific embodiment.

When a non-absorbent layer 10 is used in embodiments of the present invention, the substrate may be any of the various known or after-developed supporting materials suitable for microwave susceptor materials. Thus, for example, the substrate in embodiments of the present invention can be suitably selected from, but is not limited to, paper, board, paperboard, glassine materials, cellulose, cellophane, plastics, ceramic, and the like. These materials may be either uncoated or coated as generally known in the art. Where the susceptor material is not likely to be re-used, in interest of economics the substrate is preferably formed from coated kraft paper and other conventional kraft paper combinations conventionally used for paperboard cartons and packages. Preferably, the substrate material 10 is formed of a low density material having a relatively high thermal capacitance and heat stability sufficient to withstand cooking temperatures without exhibiting severe scorching or charring in a microwave oven. Furthermore, the substrate is preferably one that is suitable to be passed through the processing apparatus in the form either of discrete sheets or pieces, or as a continuous web.

According to the present invention, however, an absorbent property is provided to the susceptor material by incorporating therein a layer of absorbent material 50, either in combination with the conventional base material 10 or in place of the base material 10. The absorbent base material 50 is thus preferably made of a suitable absorbent material, preferably an absorbent non-woven material. One suitable example includes the materials available from Ahlstrom, such as AHLSTROM type 1278. Other suitable materials, which have been or in the future are approved by appropriate governmental or regulatory agencies, such as the United States Food and Drug Administration, for direct food contact can also be used.

In embodiments, it is preferred that the absorbent layer 50 is of a material that comprises non-woven fibers. Preferably, the non-woven fibers are non-polymeric non-woven fibers.

Preferably, the absorbent material 50 is formed of a low density material having a relatively high thermal capacitance and heat stability sufficient to withstand cooking temperatures without exhibiting severe scorching or charring in a microwave oven. Furthermore, the absorbent material substrate is preferably one that is suitable to be passed through the processing apparatus in the form either of discrete sheets or pieces, or as a continuous web.

As with the conventional base layer 10, the absorbent material 50 may be either uncoated or coated, as generally known in the art for the base layer 10. However, to help facilitate absorption of the moisture, grease/or and oil, the side of the absorbent material closest to the food product is either uncoated, or is preferably perforated or cut in the same manner as the intervening layers 20,30,40.

The thickness of the absorbent layer is not particularly limited, and can be varied based on such factors as the final use of the product, the methods by which the absorbent layer will be processed, and the like. Thus, for example, the absorbent layer can vary from thin paper, to paper board, to thick board layers of 30 points or more. As such, the end uses can vary from, for example, a flexible warp that can be processed in vertical or horizontal flow wrap machinery, to other lamination processes. Where more structural rigidity and/or absorbency is required, the absorbent layer and/or the entire susceptor structure can be fabricated, folded, shaped, die-cut, and the like to form pads, disks, sleeves, trays, tubes, boxes, folding cartons, preformed trays, elevated platforms and other packaging configurations.

Likewise, in embodiments such as shown in FIGS. 3 and 4*a*, the susceptor material of the present invention can include both the conventional base layer 10 and the absorbent layer 50. These can be joined together by any suitable method, including an optional adhesive layer 70. Other methods will be readily apparent to one of ordinary skill in the art based on the present disclosure. When both layers are present, the base layer 10 is also preferably perforated or cut in the same manner as the upper layers 20,30,40. When both layers have the perforations or cut-outs therein, the structure further facilitates wicking or absorption of food and other fluids. For example the perforations or cut-outs assist in help in absorbing and wicking away food fluids originating in the top surface of the structure. The perforations or cut-outs also help to wick or drain away fluids that may accumulate on the cooking plate, elevated cooking rack, oven floor, or other surface on which the susceptor structure and food load are placed.

In the following discussion, the term "substrate 10/50" is used to describe the base layer or substrate of the susceptor material, which according to the various embodiments can be the absorbent layer 50 by itself, or a combination of the absorbent layer 50 and the conventional base layer 10, optionally joined by an adhesive layer 70.

Next, an adhesive layer 20 can be applied to the substrate 10/50. Although, in embodiments, it is preferred that the adhesive is applied not to the substrate 10, but instead to the formed structure of the metallized layer 30 and protective layer 40, described below. This adhesive layer provides better bonding between the substrate 10/50 and the metallized film 30, so as to prevent any undesired delamination of the polyester film/metallized layer 30 from the substrate 10/50. Of course, in embodiments of the present invention where the metallized layer 30 can be suitably strongly applied to the substrate 10/50 without an adhesive 20, the omission of the adhesive layer is permissible. Alternatively, the polyester film/metallized layer 30 can be adhered to the substrate 10/50 by any conventional method, such as by co-extrusion adhesion methods, hot-melt, cold-seal, and the like, which are well known in the art.

When incorporated in embodiments of the present invention, the adhesive may be any of the various known or after-developed adhesives suitable for bonding the metallized layer to the desired substrate layer. Suitable adhesive materials that can be used in the present invention include, but are not limited to, film-forming polymers such as polyester, polyethylene, polypropylene, polyvinylbutyral, polyvinylpyrolidone, polyurethane, polycarbonates, polymethylmethacrylate, mixtures thereof, derivatives of any of the foregoing, and the like. Although not limited thereto, the adhesive can be any of the various water- and/or solvent-based adhesives generally used in the lamination arts. Selection of suitable adhesives will be readily apparent to those skilled in the art based on the present disclosure. Although the properties of the susceptor materials, including the adhesive, may vary based on particular applications, the adhesive material used in embodiments of the present invention is preferably high-temperature compatible to withstand the temperatures generated in the susceptor structure during use. The adhesive is also preferably nontoxic, and does not generate odors at elevated temperatures.

Generally the adhesive can be applied to the desired thickness by any of the various coating techniques, including but not limited to, rod coating, gravure coating, spraying, dip coating, roll coating, wire wound rod coating, extrusion, and the like. In embodiments of the present invention, the adhesive may be applied in an amount of from about 0.5 to about 2.5 lbs/1000 $ft^2$, more preferably in an amount of from about 0.9 to about 1.2 lbs/1000 $ft^2$. Of course, it will be readily apparent that the thickness can vary based on such factors as the specific type and formulation of adhesive, the adhesive setup characteristics, and the like. Drying of the deposited adhesive layer, if desired, can be effected by any suitable conventional technique including, but not limited to, oven drying, infra red radiation drying, air drying and the like.

Several factors to consider in selecting the adhesive, however, are the adhesive's high temperature adhesion and thermal conductivity. It has previously been known that the ability of a susceptor to operate is due to the metallized layer being excited by the microwave energy to produce heat. However, the present inventor has discovered that the operational performance of a susceptor can also depend upon the type, formulation and molecular configuration of that formulation and the thickness of the adhesive used in the bonding process. Some adhesive layers can be more or less transparent to the microwave energy and may themselves, in conjunction with the susceptor layer 30, reach very high temperatures, which can in turn adversely affect the adhesive bonding stability. That is, it has now been discovered that the adhesive layer also becomes excited by the microwave energy, and may itself generate and/or absorb and hold heat. However, if the adhesive is too thick, or lacks proper thermal transfer properties, the adhesive can in effect operate as a thermal dam, preventing transfer of heat energy from the metallized layer through the adhesive and into the "heat sink" substrate layer 10/50. While this may be advantageous in certain embodiments, for example where it is desired to maximize the energy—both heat and microwave—being applied to the food product, while retaining the substrate at a cool temperature, this effect of the adhesive can also have a detrimental effect upon the packaging and food product. Where the adhesive layer operates as a thermal dam, most of the heat energy is retained on the metallized layer side of the substrate. As such, a thermal energy buildup can result in the metallic layer side and especially in the protective layer 40. This build up creates excessively high temperatures and may typically exceed 220° C. (428° F.). This can in turn cause cracking and crazing of the susceptor material and protective layer 40. Thus, in embodiments, it is preferred that the adhesive layer be selected so as not to create a thermal dam, but instead to permit transfer of heat from the metallized layer, through the adhesive layer, and into the substrate layer 10/50. Preferably the partial transfer of heat is a balanced transfer of heat from the susceptor layer both into the protective layer 40 and substrate layer 10/50.

A metallized susceptor layer that forms the operational part of the susceptor is applied onto the protective layer 40, then the adhesive can be applied to the metallized layer 30. The material used for the susceptor may be any of the variously known or after-developed materials in the art and that functions as a susceptor in microwave ovens. Such materials include, but are not limited to, metals such as elemental metals, metal alloys, combinations of metals and/or alloys, oxides thereof, derivatives thereof, and the like. In particular, the material used to form the susceptor can be aluminum, copper, tin, silver, nickel, zinc, any of the various types of stainless steel, nickel-chromium alloy, titanium, Inconel, alloys of the foregoing materials, oxides of the foregoing materials, derivatives thereof, mixtures thereof, and the like. An example of Inconel is Inconel alloy 792, which has a composition in terms of weight percent of 13% chromium, 10% cobalt, 4.5% titanium, 4% tantallum, 4% tungsten, 3% aluminum, 2% molybdenum, 0.2% carbon, 0.1% zirconium, 0.02% boron, and a balance of nickel.

The metallized layer may be applied by any of the various known or after-developed methods in the art. Suitable methods include, but are not limited to, sputtering deposition, evaporative deposition, vacuum vaporization, rotary printing, electroless or electrolytic deposition, electron beam sputtering, and the like. In embodiments of the present invention, vacuum vaporization is particularly preferred because it permits the high throughput permitted by the process.

The susceptor material may be applied in any pattern to the supporting structure. Thus, for example, the susceptor material may be applied in a manner of full coverage, where a solid layer is formed, or it may be applied in a patterned manner, where there exists both areas with susceptor material and areas without susceptor material. Where a pattern of the susceptor material is used, any suitable or desired pattern can be employed, including but not limited to stripes, checker-board, concentric rings, and the like. Such patterns can be formed, for example, by such methods as dematallization processes, including selective demetallizing which combines shielding some areas and also providing susceptor heat in other areas of the packaging surface layout, in-chamber masking, pre-printing prior to metallization, and the like. For example, acid etching may be used to provide variations in susceptor radiant heat in the final product layout. In these manners, the susceptor layer can be full thickness in some areas, partial thickness in some areas, and/or completely removed in some areas to provide the desired radiant heating profile.

As is well known in the art, the susceptor material may be applied in any suitable thickness or pattern to provide the desired heating characteristics. Preferably, however, the susceptors of the present invention are formed such that the metallized layers have a thickness whereby the temperature of the surface layer of the susceptor material can reach and remain at, but preferably does not exceed, about 210° C. (about 410° F.), and preferably within the range of from about 182 to about 205° F. Thus, for example, in embodiments of the present invention where aluminum is used as the metallized layer, it is preferred that in producing the susceptor of the present invention, the metallized layer thickness be controlled so as to have an optical density (O.D.) within the range of from about 0.14 to about 0.3, preferably from about 0.19 to about 0.25, and most preferably about 0.22. Such aluminum layers provide a susceptor material that limits the dielectric heating of the susceptor surface to within the temperature range of from about 182 to about 204° C. (about 360 to about 400° F.). Where other materials (other than aluminum) are used for the metallized layer, these thicknesses will of course vary in accordance with the particular material being used.

Because of the very thin nature of the metallized layer, the thickness of the metallized layer according to the present invention is preferably measured in terms of its optical density. This measurement is used, rather than the more widely used measurement of ohms/square (Ω/□) because it has been found that the optical density measurements are more precise for such thin layers when measured in a vacuum chamber during the metallizing process, and are less affected by the actual metal deposition method. In contrast, it has been discovered that for the thin layers of the present invention, two otherwise similar metallized layers having the same optical density and dielectric heating properties, can in fact have different ohms/square measurements based on differences in the metallizing process.

As is generally well known in the art, the thickness of the metallized layer is too thin for standard length measurement techniques, so the most widely used measurements for describing the thickness of the metallized layer are surface resistivity, optical density, and visible light transmissivity. Thus, for example, the above-described optical density range of about 0.3 to about 0.1 or about 0.14 is roughly equivalent to a surface resistivity range of 440 to 470 Ω/□ and a light transmissivity of about 60 to about 80%; the above-described optical density range of about 0.25 to about 0.19 is roughly equivalent to a surface resistivity range of 450 to 460 Ω/□ and a light transmissivity of about 62 to about 75%; and the above-described optical density of about 0.22 is roughly equivalent to a surface resistivity of 455 Ω/□ and a light transmissivity of about 63%. Of course, as described above, the surface resistivity measurements are less accurate for the very thin metallized layers used in susceptors of the present invention.

Furthermore, although the above discussion focuses on the use of a single susceptor layer, as in FIGS. 2 and 3, multiple layers can be used in embodiments of the present invention. Such multiple layers are shown, for example, in FIGS. 4A and 4B. Multiple susceptor layers can be used, for example, to provide increased heat generation in all or part of the susceptor structure, to provide increased heat transfer to all or part of the food load. Such increased heat generation may be beneficial in instances where the food load otherwise would too quickly absorb the generated heat but not transfer sufficient quantities of such heat into the center of the food load. When multiple susceptor layers are used, they can be used in any desirable combination and in any desirable location in the susceptor structure.

A protective or overcoating layer 40 is typically included as a surface layer of the susceptor structure protective or overcoating layer 40 can be any material that protects the surface of the susceptor material from damage, while still allowing sufficient thermal transfer from the metallized layer to the surface of the food product. Furthermore, such materials should be materials that are generally regarded as safe (gras) or are approved by the relevant governmental entities, if appropriate, for contact with food surfaces. In embodiments of the present invention, the protective or overcoating layer 40 is preferably a polymer. According to embodiments of the present invention, suitable materials for use in constructing the protective or overcoating layer 40 generally include any relatively stable plastic substances. Examples of suitable substances for the protective or overcoating layer 40 include, but are not limited to, polyesters, polyethylene, Kapton® polymers, polyimide, polyethylene nitrile, nylon, cellophane, cellulose, polysulphone, mixtures thereof, and the like. It is important that the material of the protective or overcoating layer 40 be of sufficient stability at high temperatures that it will not degrade during the operation of the microwave oven at the temperature selected for cooking the desired food product. According to particular embodiments of the present invention, it is preferred that the protective or overcoating layer 40 be formed from polyester, which has been found to be a particularly well suited material in view of its cost, stability and its surface characteristics for metallization.

Furthermore, in embodiments of the present invention where the susceptor material is forming an entire or part of a package, the top layer of the material, such as the protective or overcoating layer 40, can be a polyester film. Alternatively, in embodiments, the top layer of the material can be a heat sealable polymer or be further coated with a sealable material, for example a heat-sealable or cold-sealable material. These embodiments facilitate easier fabrication of the packages. For example, the susceptor materials of the present invention can be conveniently used in conventional "flow wrap" processes, where the susceptor material can be easily formed and sealed on vertical or horizontal flow wrap machines.

Furthermore, in the above-described embodiments where the material includes a heat-sealable layer, where the protective or overcoating layer comprises two polyester layers, one of which forms the heat-sealable layer, for sealing a part of layer 40 to another part of layer 40 as in flow wrap or form fill and seal machines other adhesive mediums can be applied to achieve sealing action between protective layer 40 and the sealable material and also between the protective layer 40 and the substrate 10/50. Examples of suitable films include, but are not limited to Dupont OL, ICI 850 and Mylar film. Typically, such flow wrap or form fill and seal machines utilize a coextruded, two-layer (typically PET) with the outer layer being heat-sealable. These adhesives are subject to the design, form, and shape of the food container and surround. These adhesives can be either "hot-melt" adhesive or "cold" adhesives, both of which are well-known in the art.

As described above with reference to the Figures, the susceptor material of the present invention preferably includes perforations or cut-outs, to help facilitate wicking or draining of the excess moisture, grease and oil through the outer layers of the susceptor material to the absorbent layer. Although such perforations or cut-outs are not required in all embodiments, particularly where the outer layers of the susceptor are thin enough or otherwise permit wicking or draining of the moisture, grease and oil therethrough, such perforations or cut-outs increase the wicking/draining ability of such layers.

As used herein, "perforations or cut-outs" is used to refer to the formation of apertures through the outer-most layers of the susceptor material. Such apertures can be in the form of perforations, pin-holes, cut-outs, or any other suitable form. Preferably, such apertures are small enough that they do not adversely affect the ability of the susceptor layer to cook and brown the food product, while they are large enough to permit the desired wicking or draining of excess moisture, grease and oil through the susceptor structure to the absorbent layer. Thus, for example, the perforations, voids or cut-outs can be made in the form of pinholes, perforations, voids, cuts, slits, cut-outs, circles, slots or larger apertures or various designs or shapes, and the like, as desired. These various shapes are generally referred to herein as "perforations" or "cut-outs" for convenience. Two or more differently shaped and/or sized openings can also be used, as desired. It will be understood that the size, number, and design can be adjusted based, for example, on the particular food load and the volume of fluid that is to be drained away from the food load.

Preferably, in embodiments of the present invention, the susceptor structure is formed in two separate stages. First, as described above, a protective or overcoating film, such as a polyester film, is passed through a vacuum metallizing chamber, in which the susceptor (metallized) layer is applied to the protective film. Second, an adhesive layer is optionally applied to a supporting substrate material. The combined metal/film structure can be bonded to the adhesive layer of the supporting substrate (or the adhesive/metal/film structure can be bonded to the supporting substrate). Alternatively, these production steps can be combined into a single in-line process, where adhesive is applied to the metallized film, after which the adhesive structure is bonded to a supporting substrate layer. Other modifications of the production process will be readily apparent to those skilled in the art in view of the present disclosure.

In modifications of the invention where a susceptor layer is placed on both sides of the substrate, as shown for example in FIGS. 4*a*-4*b*, the above processes can be suitable modified. For example, in the two-step process, two separate structures of the adhesive/metal/film structure can be bonded to opposite faces of the supporting substrate, either in a single step or in subsequent steps.

In a separate step of the process, the layers of the susceptor are perforated, as described above. Such perforation treatment can be conducted at any suitable stage of the process. For example, the perforations can be formed in the individual layers prior to assembly, can be formed in the combined adhesive/metal/film structure prior to bonding to the substrate, or can be formed in the final resultant product subsequent to assembly of all of the layers. In embodiments, it is preferred that the perforation treatment is conducted after all of the layers are assembled, as this method ensures clear paths from the outside of the susceptor material to the absorbent layer.

When forming the perforations or cut-outs, the perforations can be suitable made through some or all of the layers of the susceptor structure. Thus, for example, the perforations can penetrate completely through the adhesive/metal/film structure without penetrating the absorbent substrate 50. Alternatively, the perforations can partially penetrate the absorbent substrate 50 to permit increased wicking or draining of excess moisture, grease and oil into the absorbent substrate 50. This is particularly preferred where the absorbent substrate 50 is a coated material, where the coating may interfere with wicking or draining into the substrate. Alternatively, the perforations, cut-outs or the like can penetrate completely through the film structure/metal/adhesive/absorbent substrate to permit drainage through the entire structure, in particular if the food and susceptor package are resting on an elevated cooking rack in keeping with optimized reflected microwave energy from the oven base. As described above, the perforations or cut-outs referred to herein can be in the shape, size, form or the like of pinholes, perforations, voids, cuts, slits, cut-outs, circles, slots or larger apertures or various designs or shapes, and the like.

Although the invention has heretofore been described with reference to the particular embodiments of the Figures, the invention is by no way limited to this particular structure. For example, as will be apparent to those skilled in the art, additional layers may be included in the susceptor material for their known purposes. For example, if desired, a polymer coating can be applied to the substrate, either prior to or in place of the above-described adhesive layer, for the purpose of sealing and smoothing the substrate surface. Such a layer is described in, for example, U.S. Pat. No. 5,614,259, the entire disclosure of which is incorporated herein by reference.

Figure 5A:
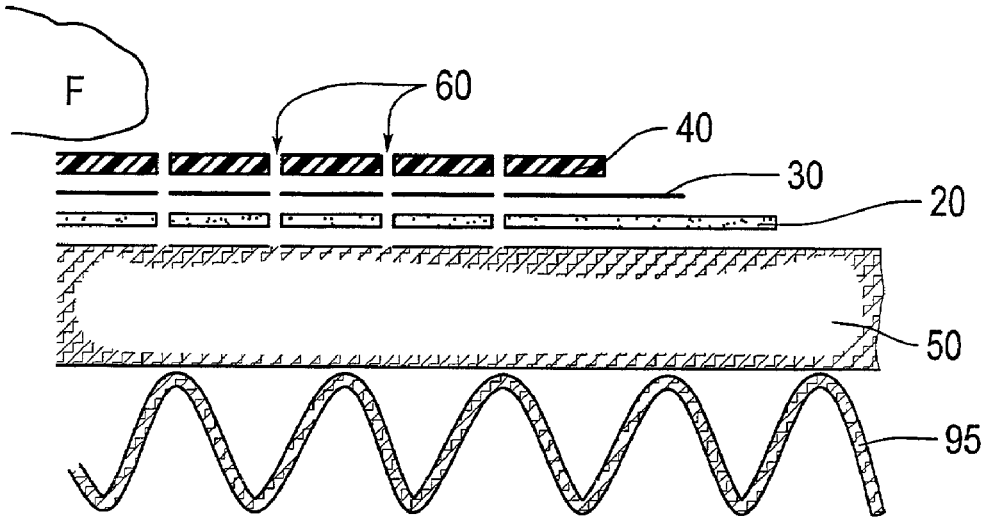
FIGS. 5*a*-5*b* show the layers of susceptor materials according to other modified embodiments of the present invention.
Figure 5B:
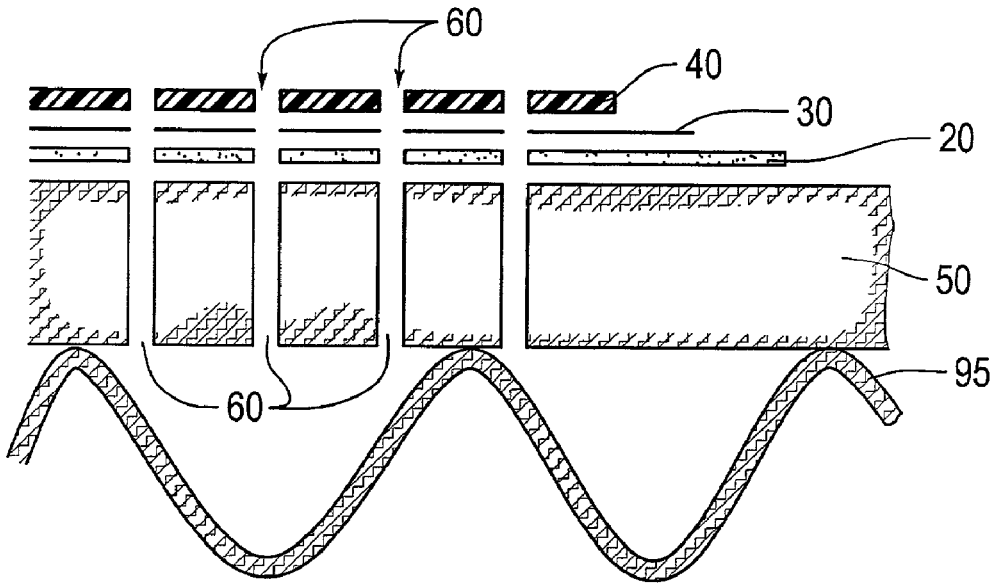

In other embodiments of the present invention, the susceptor structure may also include one or more layers for elevating the food load. Such layers can be, for example, in the form of corrugated materials. For example, FIGS. 5*a* and 5*b* depict embodiments of the present invention that generally correspond to the embodiment of FIG. 2, but that include a corrugated layer 95. FIG. 5*a* shows the structure of FIG. 2, but further including the corrugated layer 95. FIG. 5*b* shows the structure of FIG. 5*a*, but where the perforations or cuts 60 extend completely through the layers 40,30,20,50, such that liquid can be absorbed by the absorbent layer 50 and/or collected in the troughs of the corrugated layer 95. The corrugated layer 95 can be formed of any suitable material, including the materials described above for the non-absorbent layer 10 and the absorbent layer 50. Preferably, the corrugated layer 95 is formed of a corrugated paper, paperboard, board formed into a corrugated profile shape, board such as corrugated cardboard, or the like. Preferably, although not limited thereto, the corrugated layer 95 is formed of a material having a weight rating of from about 20 to about 80 pounds/ream.

Figure 6:
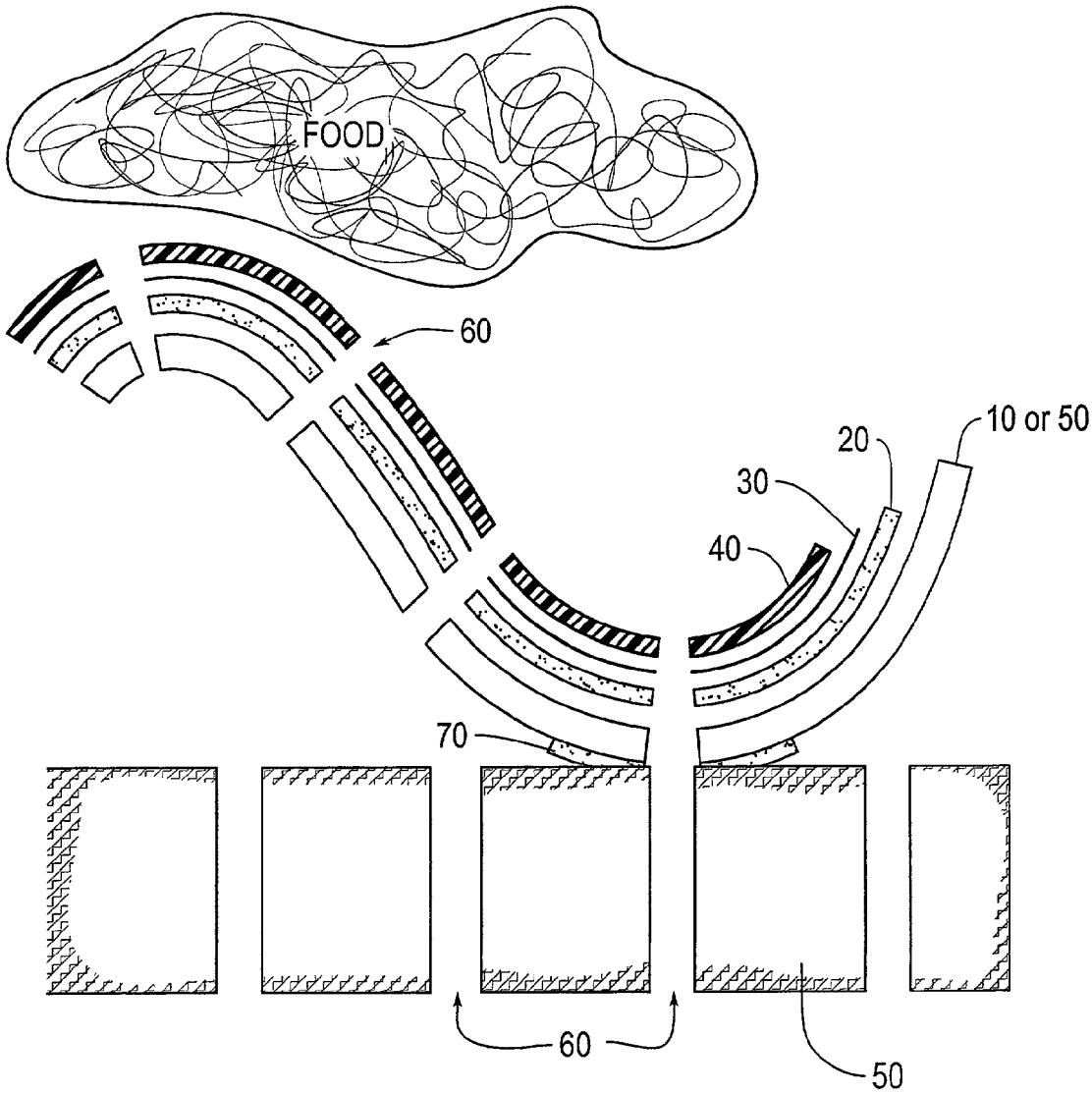
FIG. 6 shows the construction of a susceptor according to an embodiment of the present invention.

In a still further modification of the present invention, the corrugated layer can instead be formed of the susceptor material itself, or a portion thereof. For example, FIG. 6 shows an embodiment of the present invention where the layers 40,30, 20,10/50 are formed in a corrugated fashion. This corrugated material is then applied by means of an adhesive material 70 to a base material. The base material shown in FIG. 6 is an absorbent material layer 50, but could instead be a non-absorbent layer 10. When adhesive layer 70 is used, the adhesive material may be any of the suitable adhesives described above, or other adhesive suitable for applying the corrugated structure to the base material.

In the above discussion, the various layers of the susceptor structure have been described as being in a particular general order. However, the construction is not limited to those layer orders described above. For example alternative susceptor structure constructions include embodiments where the susceptor layer is located toward the inside of the structure. When so located, the susceptor layer continues to provide the effect of microwave absorption and heat generation.

Figure 7:
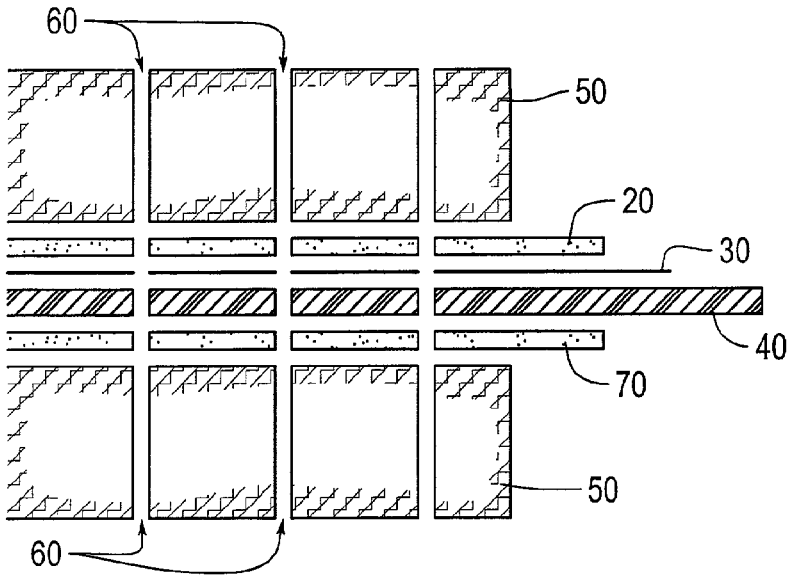
FIG. 7 shows the construction of a susceptor according to another embodiment of the present invention.

For example, FIG. 7 depicts an embodiment where the susceptor layer 30 is located internal of the susceptor structure, with an absorbent layer 50 located on either side of the susceptor layer. Of course, one of the layers 50 could be substituted by a non-absorbent material layer 10, as desired. The structure is shown as including a further adhesive layer 70, although either or both of the adhesive layers 20,70 could be substituted by other attachment methods, such as extrusion lamination.

Figure 8:
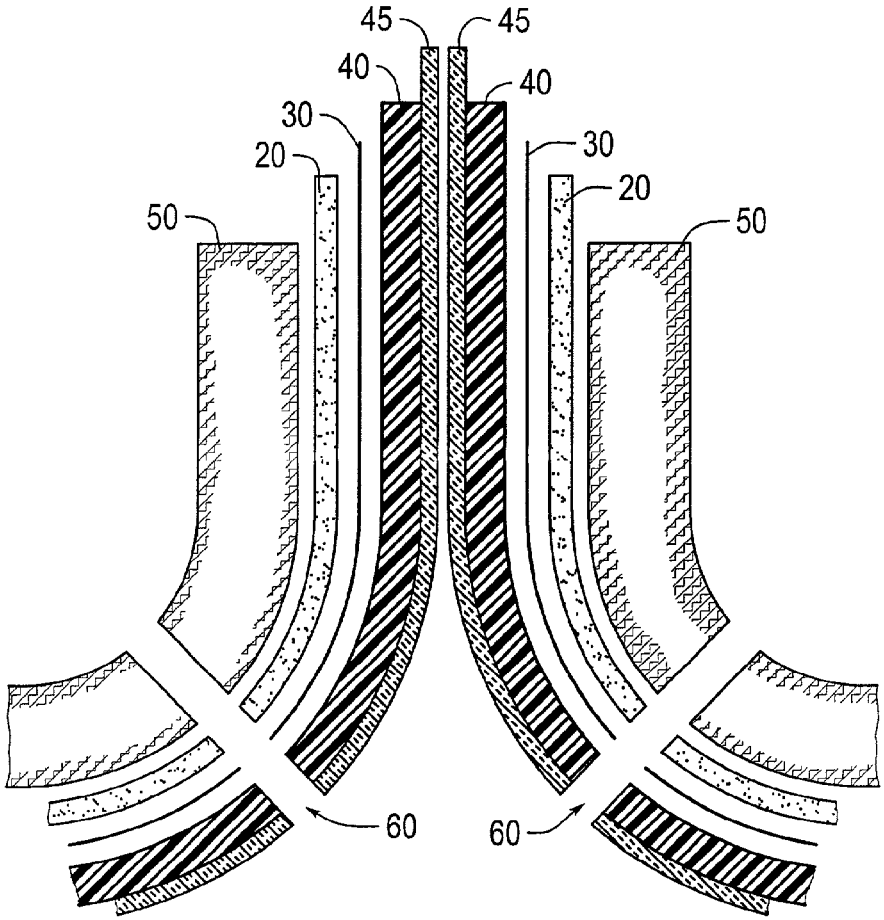
FIG. 8 shows the construction of a susceptor according to another embodiment of the present invention.

A modification of this embodiment is shown in FIG. 8. FIG. 8 shows a multi-layer structure having two susceptor layers 30, and an exemplary means of assembling the structure. The structure includes 50,20,30,40 as described in detail above, with a layer of heat seal/cold seal material 45 applied to the otherwise protective layer 40. The structure can be assembled, for example, by preparing a material having the illustrated layers 50,20,30,40,45 (which can be in any suitable or desired order) and then laminating the respective layers together to form an interface of the two heat seal/cold seal material layers 45. It is also envisioned that the susceptor layer 30 may or may not be positioned in the sealing area, depending on the process method of the susceptor layer.

As described above, the susceptor material of the present invention may be used in various forms to provide a wide range of cooking substrates. Thus, the material may be used as is to form a cooking and/or packaging material, or may be used in combination with other conventional material to form a combined or separable packaging/cooking structure. The susceptor structure may then be die cut, folded, pressed, shaped, or the like into cartons, preformed trays containers, or the like, and may be optionally decorated with printing, to form a package into which food may be inserted by a food processor. Final constructions can be in the form of, for example, pads, disks, sleeves, trays, tubes, boxes, folding cartons, pre-formed trays, elevated platforms and other packaging configurations.

Figure 9A:
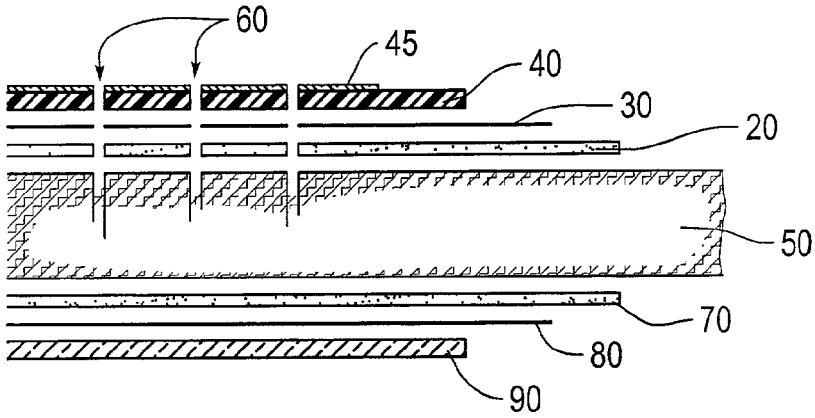
FIG. 9*a* shows the construction of a susceptor according to another embodiment of the present invention.
Figure 9B:
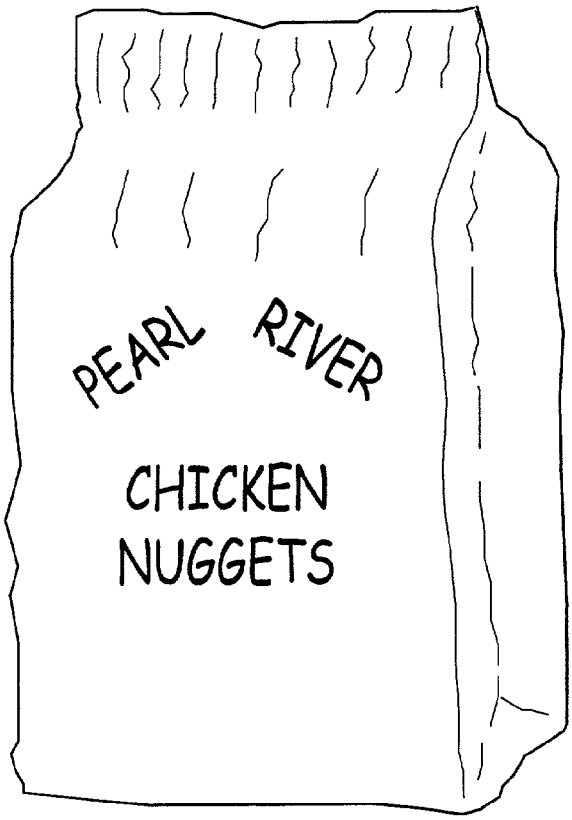
FIG. 9*b* shows a package element formed from the susceptor material of FIG. 9*a*.

One example of a final product according to the present invention is shown in FIGS. 9*a* and 9*b*. FIG. 9*a* shows a multi-layer susceptor material according to the present invention. The structure includes layers 45,40,30,20,50 as described above, where the food load would be placed in contact with the layer 45. The material further comprises, on the opposite side of the absorbent layer 50, a layer of printed matter of ink 80, optionally applied to the layer 50 by a layer of adhesive 70, and which is overcoated by protective layer 90. The layer 50 can be either coated or uncoated, as desired, for enhanced surface point quality. In embodiments, it is preferred that the protective layer 90 has any printed matter or ink 80 placed on an inner side of the protective layer, in a manner known in the art as "reverse printing." Alternatively, printed ink layer 80 may be processed directly onto the surface of layer 50 and layer 90 may be a suitable and approved clear overcoating or lacquer.

The protective layer 90 can be formed of the same materials described above for the protective layer 40, or other suitable material commonly used for packaging materials including polyester, polypropylene, or other acceptable flexible films suitable for this application. The thus-formed structure can be formed into any suitable shape, such as a bag as shown in FIG. 9*b*.

Of course, the structure of a final product is in no way limited to a bag as shown in FIG. 9*b*. Rather, any of the above-described and other forms can be provided. Several exemplary, but non-limiting, forms are described below.

Figure 10A:
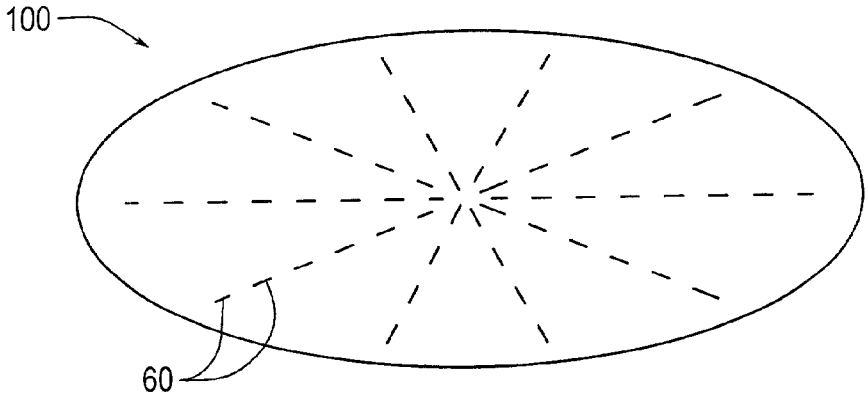
FIGS. 10*a*-10*q* show various package elements formed from the susceptor material of the present invention.
Figure 10B:
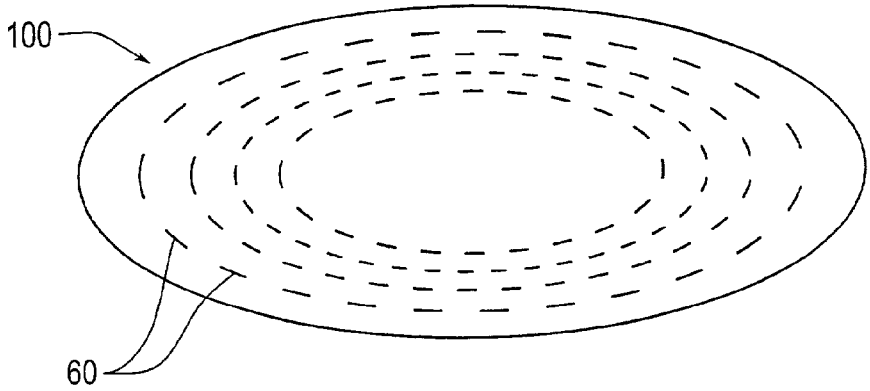
Figure 10C:
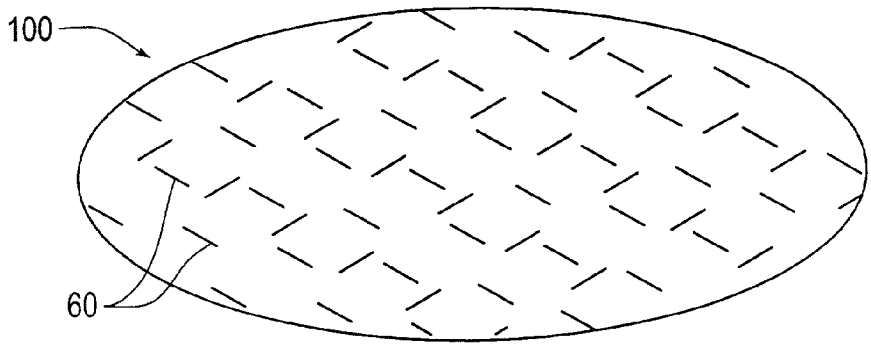

FIGS. 10*a*-10*c* show the susceptor material formed into a disk. The disk-shaped structure 100 includes the perforations or cuts formed into different configurations, as shown.

Figure 10D:
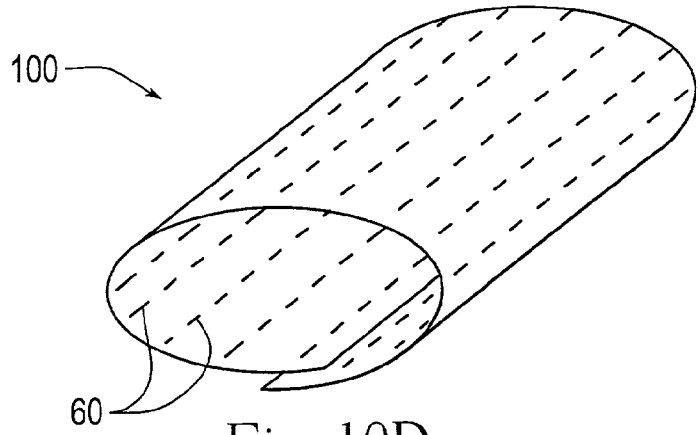

FIG. 10*d* shows the susceptor material formed into a tube. The tube-shaped structure 100 includes the perforations or cut-outs, as shown.

Figure 10E:
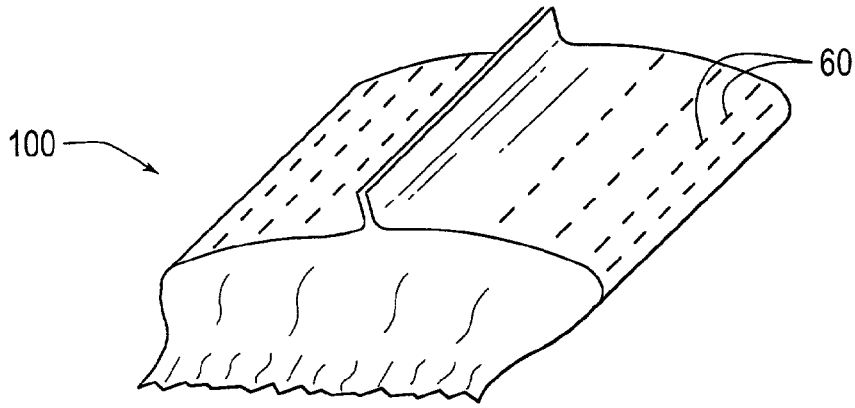

FIG. 10*e* shows the susceptor material formed into a flow-wrap pouch. The pouch-shaped structure 100 includes the perforations or cut-outs, as shown.

Figure 10F:
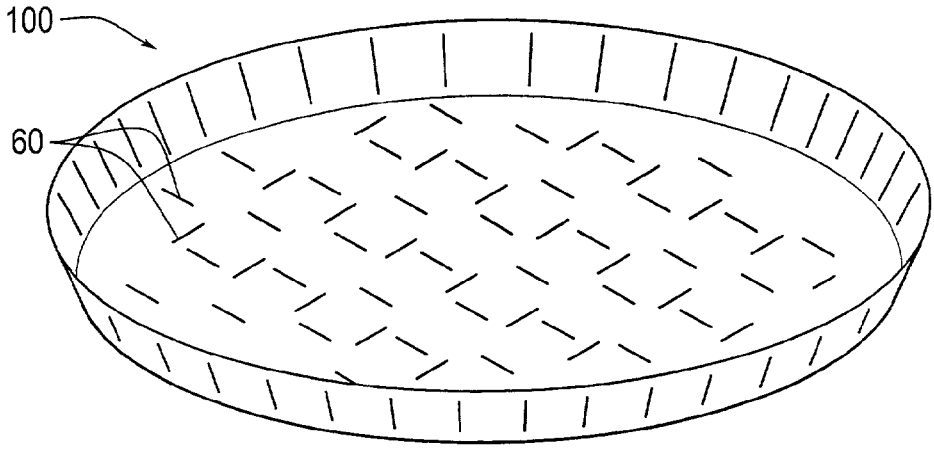

FIG. 10*f* shows the susceptor material formed into a pre-formed plate or tray. The tray-shaped structure 100 includes the perforations or cut-outs, as shown.

Figure 10G:
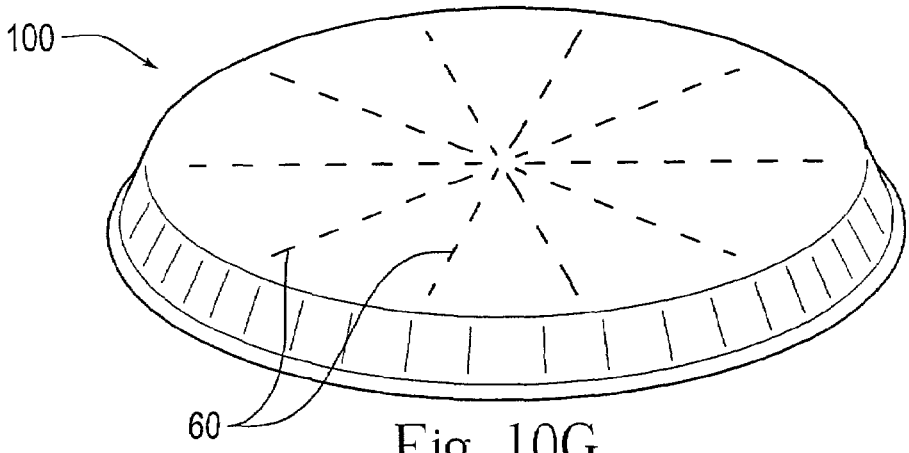

FIG. 10*g* shows the susceptor material formed into a preformed tray that is reversed to provide an elevated cooking platform. The tray-shaped structure 100 includes the perforations or cut-outs, as shown.

Figure 10H:
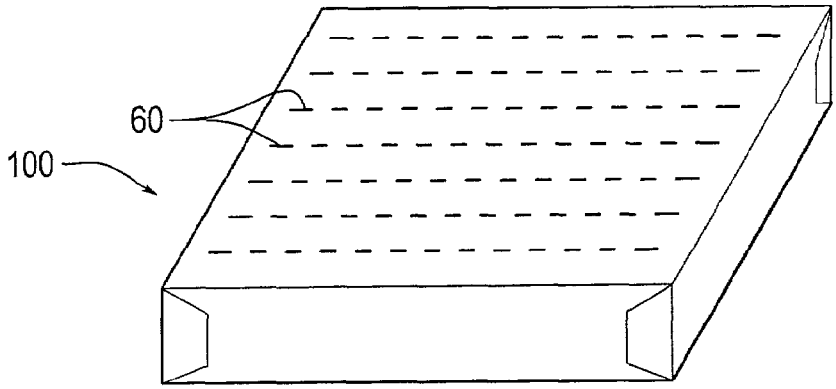

FIG. 10*h* shows the susceptor material formed into a tray that is provided with "click-lock/sprinter" type corners that enable the tray to be assembled into an elevated cooking platform. The tray-shaped structure 100 includes the perforations or cut-outs, as shown.

Figure 10I:
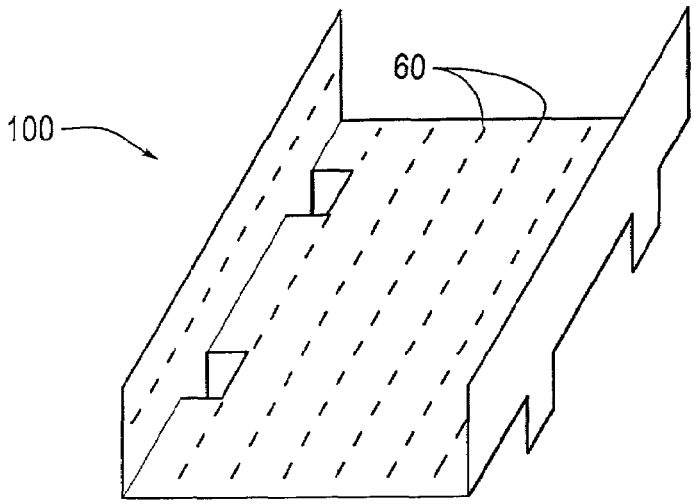

FIG. 10*i* shows the susceptor material formed into a preformed erected tray, where the tray forms an elevated cooking platform having open ends. The tray-shaped structure 100 includes the perforations or cut-outs, as shown.

Figure 10J:
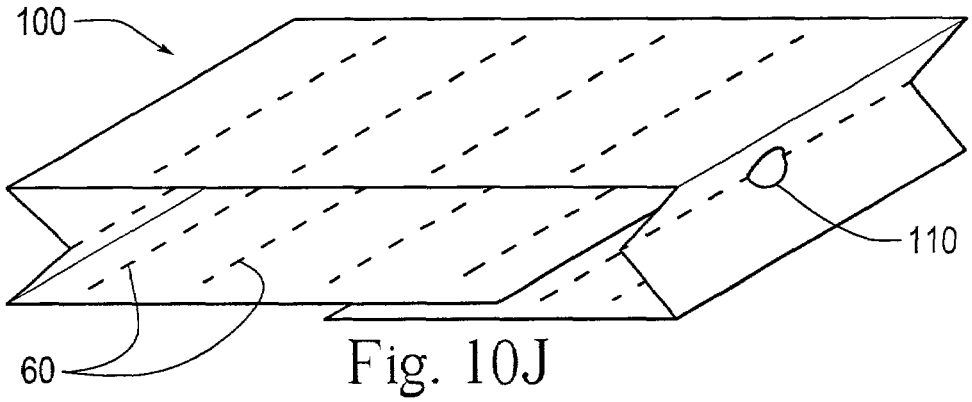
Figure 10K:
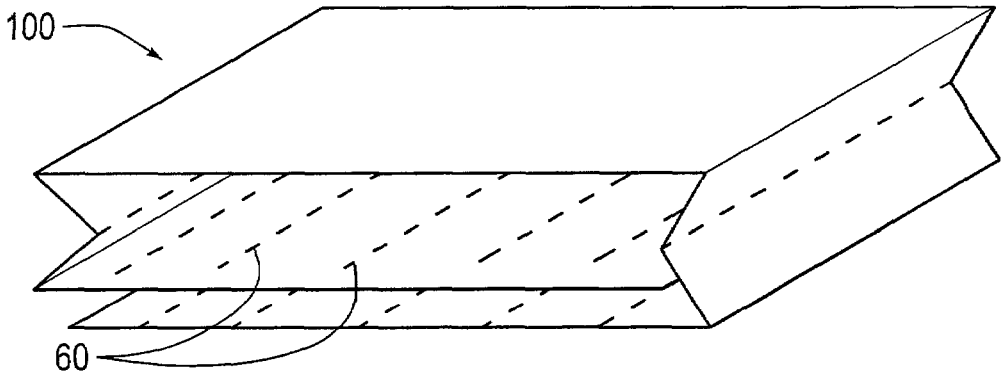
Figure 10L:
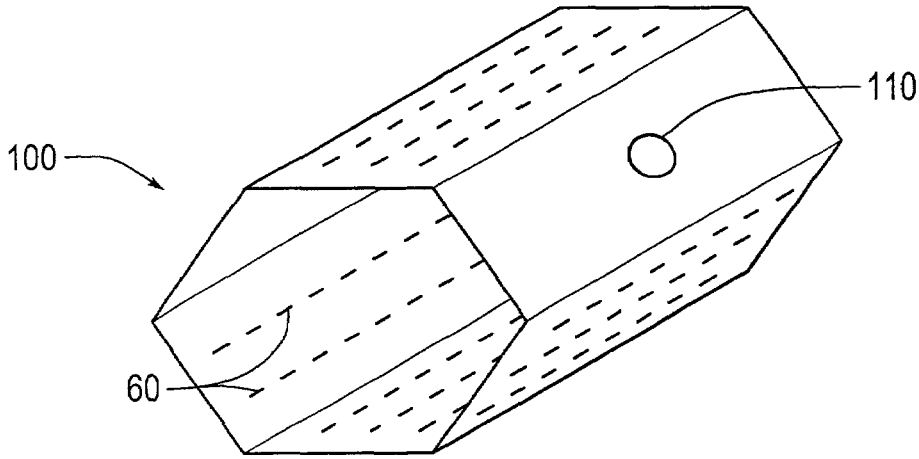

FIGS. 10*j-l* show the susceptor material formed into sleeves, where the sleeve has open ends or flaps to partially close the ends and having a gusseted side wall or other design mechanism to provide a compression tension to draw the upper and lower surfaces toward each other. The sleeve-shaped structure 100 includes the perforations or cut-outs, as shown. The sleeve can also have one or more vent holes 110, as shown in FIGS. 10*j* and 10*l*. FIG. 10*k* shows a design with double layer back layers that provide increased heat and absorbency to the base of the heating sleeve.

Figure 10M:
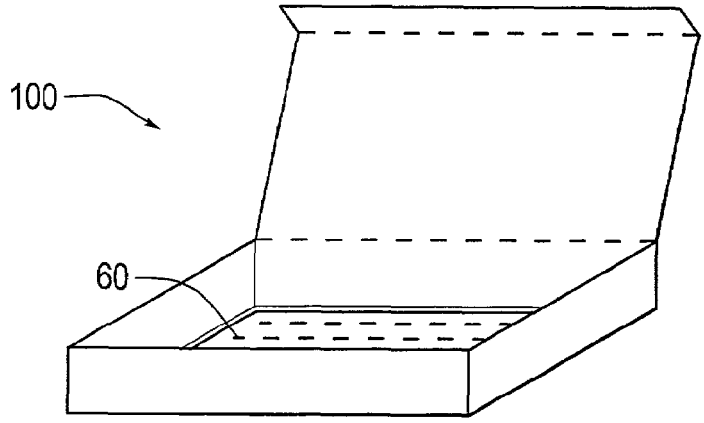

FIG. 10*m* shows the susceptor material as a pad that is patch-laminated into the bottom or other inner surface layers of the folding carton. Alternatively, a microwave absorbent pad may be positioned in the base of the carton where the absorbent qualities require a very thick absorbent layer 50 that may otherwise be unsuitable for flexible reel patch lamination processing. The pad-shaped structure 100 includes the perforations or cut-outs, as shown.

Figure 10N:
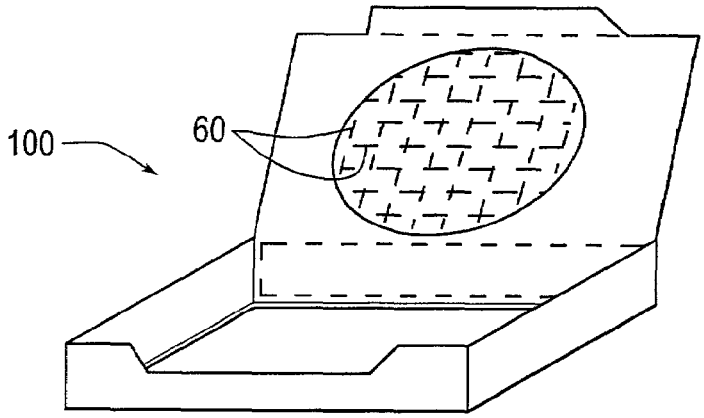

FIG. 10*n* shows the susceptor material as a pad or disk that is patch-laminated into the bottom or underside of a carton lid, on other inner surfaces. The pad-shaped structure 100 includes the perforations or cut-outs, as shown.

Figure 10O:
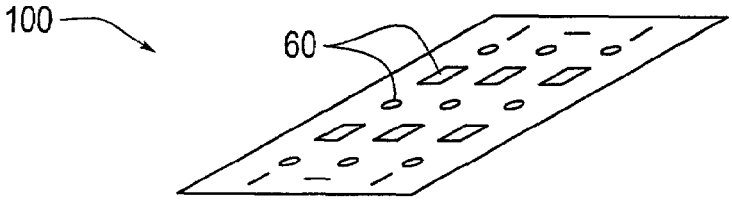

FIG. 10*o* shows the susceptor material as a pad or base where the food load is positioned on the pad as a support for the product within a flexible outer pouch made on a "flow-wrap" machine. The end-user would, for example, use this microwave susceptor base to re-heat the food.

Figure 10P:
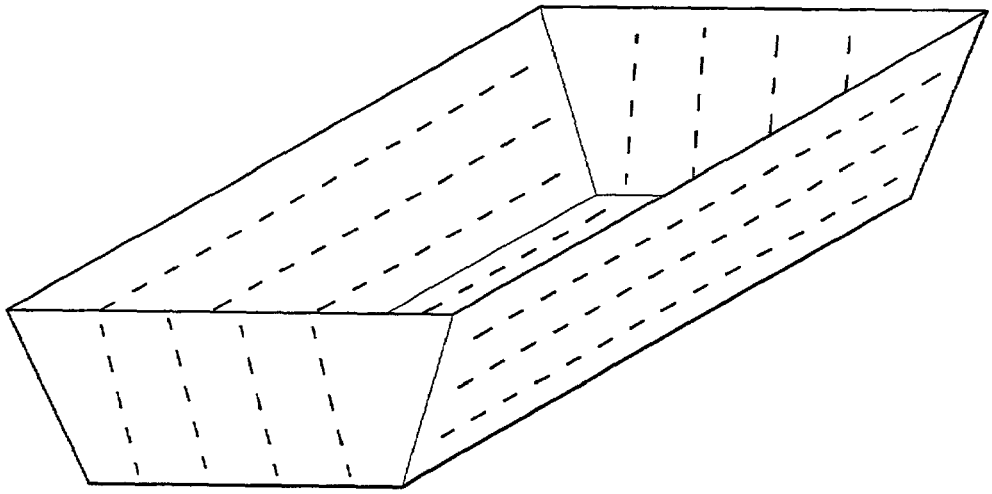

FIG. 10*p* shows the susceptor material formed as a uniformly angled side wall tray.

Figure 10Q:
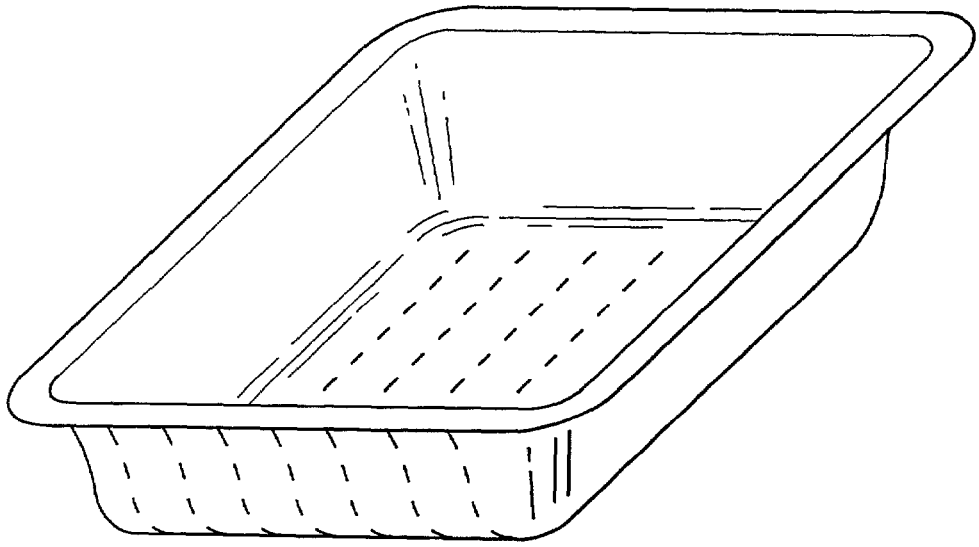

FIG. 10*q* shows the susceptor material formed into a preformed rectangular tray.

Numerous other constructions will be apparent to those of ordinary skill in the art, and can be readily prepared based on the present specification.

According to the present invention, a susceptor material is provided that provides unexpectedly improved results over the materials of the prior art. The present invention achieves these results by providing a susceptor material that includes an absorbent substrate for absorbing excess moisture, grease and oil that is liberated from the food product during the cooking process. The result is a susceptor material that provides improved cooking and browning to a food product, without a moisture build-up that otherwise would result in a soggy, unappealing product.

By removing and absorbing the moisture, grease and oil into the absorbing layer as it is released from the food during the cooking process, the outer food coating of the food load no longer sits in a "puddle" of moisture, grease and/or oil while cooking. This drainage of the moisture, grease and/or oil from the surface of the susceptor layer reduces and in some cases eliminates the "puddling" effect and significantly reduces moisture build-up, especially in the case of bread or batter coatings that otherwise would result in a soggy and unappealing final product.

The following examples are illustrative of embodiments of the present invention, but are not limiting of the invention. It will be apparent, however, that the invention can be practiced with many types of materials and can be formed into different structures for a variety of different uses in accordance with the disclosure above and as pointed out hereinafter.

EXAMPLES

Example I

A susceptor according to the present invention is produced as follows. First, AHLSTROM type 1278, a non-woven fiber board available from Ahlstrom, is used as a substrate layer. Next, a layer of aluminum is vacuum deposited onto a thin polyester protective film to a thickness having an optical density of about 0.22. To the metallized polyester film is applied a layer of adhesive. The adhesive layer is then applied to the non-woven fiber board to form the final product. The susceptor structure is perforated from the polyester protective film through the adhesive layer and may pierce completely through the substrate layer.

A frozen fish fillet with a layer of breading/batter is placed on the susceptor material surface. The susceptor and fish fillet is cooked for a period of 5½ minutes.

After the cooking time, it is observed that the water and oil released from the fish fillet during the cooking process is absorbed into the absorbent layer of the susceptor material. A crisp, cooked fish fillet is provided.

Comparative Example I

Following the same steps as in Example I, a comparative susceptor specimen is produced using the same materials and processes, except that instead of the absorbent non-woven fiber board, a 14-point kraft paper board is used as the substrate.

The susceptor material is tested according to the same procedures as Example I, and at the same time and in the same microwave oven as that described in Example I. Visual inspection of the cooked susceptor evidences that the moisture and oil fluids have not been absorbed into the susceptor material, and the cooked fish fillet is soggy. Moisture and oil was absorbed only absorbed only on the exposed outer edge of the 14 point craft paper board. The volume of moisture, grease and oil released from the same food load as used in Example 1 formed a significant puddle of fluid where the under surface of the fish fillet was laying, causing the batter to be soggy and unappealing.

As will be apparent to one of ordinary skill in the art, numerous changes, alterations and adjustments can be made to the above-described embodiments without departing from the scope of the invention, and the invention is in no way limited to the specific exemplary embodiments described above. One skilled in the art will recognize that the various aspects of the invention discussed above may be selected and adjusted as necessary to achieve specific results for a particular application. Thus, the foregoing embodiments are intended to illustrate and not limit the present invention. It will be apparent that various modifications can be made without departing from the spirit and scope of the invention.

What is claimed is:

1. A susceptor comprising:

an absorbent substrate layer;

a first susceptor layer comprising microwave susceptor material over said absorbent substrate layer;

a supporting substrate between said absorbent substrate and said first susceptor layer;

a first protective overcoating layer over said first susceptor layer; and perforations or cut-outs formed through said first protective overcoating layer, said first susceptor layer, and said supporting substrate, to permit wicking and draining of liquid through said first protective overcoating layer, said first susceptor layer, and said supporting substrate to said absorbent substrate layer, wherein said absorbent substrate layer comprises non-woven fibers, and wherein said perforations or cut-outs are located in said susceptor at least in an area beneath an applied food load and between said absorbent substrate layer and said applied food load and wherein said perforations or cut-outs do not extend through the entire susceptor.

2. The susceptor of claim 1, wherein said non-woven fibers are non-polymeric fibers.

3. The susceptor of claim 1, wherein said first susceptor layer is formed from a material selected from the group consisting of elemental metals, metal alloys, oxides thereof, derivatives thereof, and combinations thereof.

4. The susceptor of claim 1, wherein said first susceptor layer is formed from a material selected from the group consisting of aluminum, copper, tin, silver, nickel, zinc, stainless steel, nickel-chromium alloy, titanium, Inconel, alloys of the foregoing materials, oxides of the foregoing materials, derivatives thereof, and mixtures thereof.

5. The susceptor of claim 1, further comprising an adhesive layer between said absorbent substrate and said first susceptor layer.

6. The susceptor of claim 5, wherein said adhesive layer is at least partially thermally conductive to conduct heat generated in said susceptor layer to said underlying substrate layer.

7. The susceptor of claim 1, wherein said first susceptor layer is formed from vacuum deposited aluminum.

8. The susceptor of claim 1, further comprising a second susceptor layer separated from said first susceptor layer.

9. The susceptor of claim 1, wherein said first susceptor layer is a metallized layer.

10. The susceptor of claim 1, further comprising:

a second susceptor layer comprising microwave susceptor material over on opposite side of said substrate layer from said first susceptor layer; and a second protective overcoating layer over said second susceptor layer.

11. The susceptor of claim 10, wherein said second protective overcoating layer and said second susceptor layer are not perforated.

12. The susceptor of claim 10, wherein said second protective overcoating layer and said second susceptor layer are perforated.

13. The susceptor of claim 10, further comprising a supporting substrate at least one of between said absorbent substrate and said first susceptor layer and between said absorbent substrate and said second susceptor layer.

14. The susceptor of claim 10, further comprising a first supporting substrate between said absorbent substrate and said first susceptor layer and a second supporting substrate between said absorbent substrate and said second susceptor layer.

15. The susceptor of claim 1, comprising a layer of corrugated material.

16. The susceptor of claim 15, wherein said corrugated layer comprises said absorbent substrate layer.

17. The susceptor of claim 15, wherein said corrugated layer comprises said first susceptor layer and said first protective overcoating layer.

18. The susceptor of claim 15, wherein said corrugated layer is physically distinct from said absorbent substrate layer.

19. The susceptor of claim 15, further comprising perforations formed through said first protective overcoating layer and said first susceptor layer, to permit wicking and draining of liquid through said first protective overcoating layer and said first susceptor layer to said absorbent substrate layer, but not through said corrugated layer.

20. A susceptor comprising:

a first absorbent layer;

a second absorbent layer;

a first susceptor layer comprising microwave susceptor material between said first absorbent layer and said second absorbent layer;

a supporting substrate between said first susceptor layer and at least one of said first absorbent layer and said second absorbent layer;

a first protective overcoating layer over said first absorbent layer; and perforations or cut-outs formed through said first protective overcoating layer, said first absorbent layer, said first susceptor layer, and said supporting substrate, to permit wicking and draining of liquid through said first protective overcoating layer, said first absorbent layer, said first susceptor layer, and said supporting substrate to said second absorbent layer, wherein at least one of said first absorbent layer and said second absorbent layer comprises non-woven fibers, and wherein said perforations or cut-outs are located in said susceptor at least in an area beneath an applied food load and between said first absorbent layer and said applied food load and wherein said perforations or cut-outs do not extend through the entire susceptor.

21. A packaging system for a microwavable food product, said packaging system comprising a susceptor according to claim 1.

22. A packaging system for a microwavable food product, said packaging system comprising a susceptor according to claim 15.

23. A packaging system for a microwavable food product, said packaging system comprising a susceptor according to claim 20.

24. The packaging system according to claim 21, wherein said packaging system is in a form selected from the group consisting of a bag, a pouch, a tray, a pad, a disk, a sleeve, a patch, a liner, and a lid.

* * * * *